US005795128A

United States Patent [19]

Eichstadt

[11] Patent Number: 5,795,128

[45] Date of Patent: Aug. 18, 1998

[54] CONTROL DEVICE FOR A PIVOT INTEGRATED IN A MANIFOLD

[75] Inventor: Frédéric Paul Eichstadt, Livry/Seine, France

[73] Assignee: Societe Nationale d'Etude et de Construction de Moteurs d'Aviation "SNECMA", Paris, France

[21] Appl. No.: 814,340

[22] Filed: Mar. 11, 1997

[30] Foreign Application Priority Data

Mar. 14, 1996 [FR] France ..... 96 03203

[51] Int. Cl.[6] ..... F01D 17/16; F01D 9/06

[52] U.S. Cl. ..... 415/160; 415/115

[58] Field of Search ..... 415/115, 159, 415/160, 161, 162

[56] References Cited

U.S. PATENT DOCUMENTS

| | | | |
|---|---|---|---|
| 4,193,738 | 3/1980 | Landis, Jr. et al. | 415/115 |
| 4,214,851 | 7/1980 | Tuley et al. | 415/159 |
| 4,314,791 | 2/1982 | Weiler | 415/159 |
| 4,972,671 | 11/1990 | Asselin et al. | 415/161 |
| 5,492,446 | 2/1996 | Hawkins et al. | 415/160 |
| 5,593,275 | 1/1997 | Venkatasubbu et al. | 415/160 |

*Primary Examiner*—Christopher Verdier
*Attorney, Agent, or Firm*—Oblon, Spivak, McClelland, Maier & Neustadt, P.C.

[57] ABSTRACT

A control device for the pivot of a variably settable movable vane mounted so that the pivot is integrated in an air manifold comprises a rotatable mounting for pivotally mounting the pivot in a bore in a platform fixed to the manifold by upstream and downstream flanges, a link for rotating the pivot to vary the setting of the vane, and a ring mounted outside the manifold and connected to the link for controlling the setting of the vane. The rotatable mounting for pivotally mounting the pivot in the bore comprises an end piece which is fitted on the pivot and which itself fits within a hollow friction bush fixed in the bore. The bush is provided with a slit extending partly around its circumference, and the upstream end of the link projects through the slit via apertures in the manifold and the platform to engage with an eye provided on the pivot end piece which receives a correspondingly shaped intermediate portion of the end piece. The pivot is hollow to allow hot de-icing air from the manifold into the interior of the vane.

6 Claims, 3 Drawing Sheets

CONTROL DEVICE FOR A PIVOT INTEGRATED IN A MANIFOLD

BACKGROUND OF THE INVENTION

The invention relates to a control device for a pivot integrated in a manifold, and is applicable in particular to turbomachines equipped with a bladed air intake guide having variably settable vanes.

Some turbomachines have variably settable guide vanes permitting regulation of the flow of air to compressor stages situated downstream. The vanes comprise pivots which project through an envelope defining a flow path, and each pivot is rotatable by means of a link connected to a control mechanism, such as a ring, which is displaceable to cause all the links, and hence the vanes, to swivel in unison.

To prevent ice from forming on the surface of the movable vanes, it is known to take hot air from the high pressure compressor to supply an air manifold, and to inject the air from the manifold into the vanes, for example through the pivots, so that the air circulates in the vanes.

However, the space available between the engine casing and the tips of the vanes is generally small, and it is often difficult, if not impossible, to house in this space a device for controlling the setting of the vanes as well as a de-icing device for the movable vanes.

The aim of the invention is to solve this problem and to provide a control device for a pivot integrated in a manifold which will permit the de-icing of the movable vanes while at the same time attending to the setting of the movable vanes.

SUMMARY OF THE INVENTION

For this purpose, according to the invention there is provided a control device for the pivot of a variably settable movable vane mounted so that said pivot is integrated in an air manifold by means of a platform which is fixed to said manifold by upstream and downstream flanges and which is provided with a bore for receiving said pivot, said control device comprising means for pivotally mounting said pivot in said bore, a link for rotating said pivot to swivel said movable vane and thereby vary the setting thereof, and means connected to said link for controlling the swivelling of said movable vane, said means for pivotally mounting said pivot including a hollow friction bush fixed in said bore, said hollow bush having a slit extending partly around the bush in a circumferential direction, and said link having an upstream end part which projects through said slit.

Preferably the means for controlling the swivelling of said movable vane is mounted outside said manifold and is connected to a downstream end part of said link, and wherein said upstream end part of said link projects through said slit of said hollow bush via apertures provided in said manifold and said platform, the slit preferably facing the apertures in the platform and the manifold.

In a preferred embodiment the upstream end part of said link comprises a flat portion provided with an eye having a predetermined shape and section, said flat portion projecting through said slit of said hollow friction bush, and said means for pivotally mounting said pivot further includes a hollow end piece fitted on said pivot, and a clamping nut, said hollow end piece comprising a lower part into which said pivot is fitted and which itself fits into said hollow friction bush, an intermediate part which fits into said eye of said upstream part of said link, and a threaded upper part on which said clamping nut is screwed.

The pivot is preferably hollow to allow a flow of hot air from the manifold into the interior of the vane for the purpose of deicing the vane.

Flange to flange fixings between the manifold and the platform ensure sealing between the inside and the outside of the manifold.

Other features and advantages of the invention will become apparent from the following description of the preferred embodiment, given by way of example, with reference to the attached drawings.

DESCRIPTION OF THE PREFERRED EMBODIMENT

Figure 1:
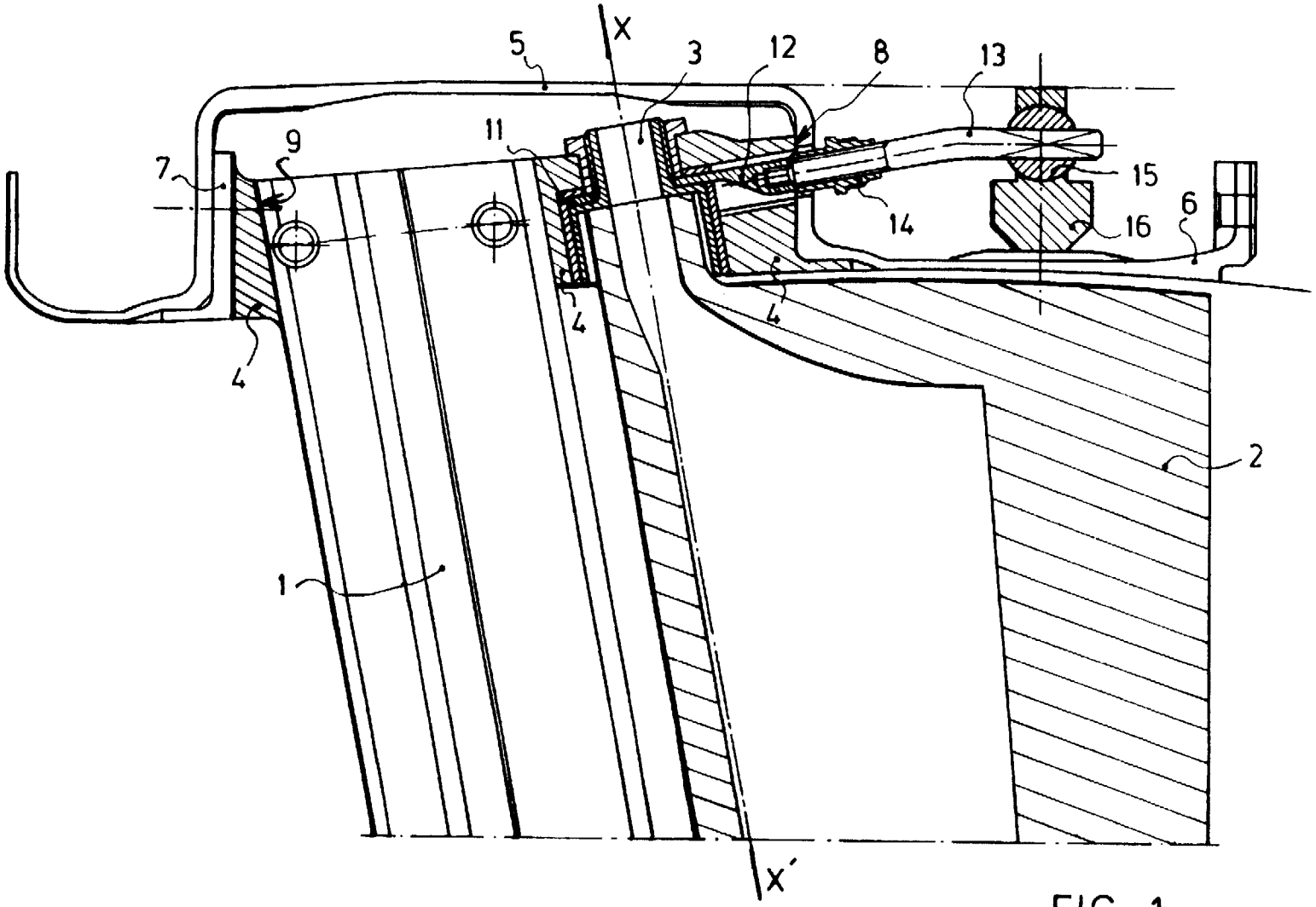
FIG. 1 is a diagrammatic axial sectional view of one embodiment of a device in accordance with the invention for controlling the setting of a movable guide vane in a turbojet engine.

In the embodiment shown in FIG. 1, a turbojet engine air intake is equipped with fixed arms 1 and movable guide vanes 2, each vane 2 being movable around a radial axis XX' passing through a pivot 3 situated at the outer tip of the vane 2.

The fixed arms 1, the movable vanes 2 and the pivots 3 are hollow, so as to permit the circulation of hot de-icing air taken from the outlet of the high pressure compressor (not shown).

The fixed arms 1 and the pivots 3 of the movable vanes 2 are mounted in outer platforms 4 arranged in mutual contact, and are capped by an air manifold 5 rigidly connected to an outer ring 6.

Each platform 4 has two transverse flanges 7,8 adjacent its upstream and downstream edges by which the platform is fixed to corresponding flanges of the manifold 5 such as by means of a nut and bolt arrangement. The platforms 4 and the manifold 5 together form an annular enclosure which accommodates, contains and dispenses the de-icing air for the fixed arms 1 and the movable vanes 2. Sealing of the inside of the manifold from the exterior is ensured by means of the flange to flange fixings between the manifold 5 and the platforms 4.

Each platform 4 also has, on its outer face between the two transverse flanges 7 and 8, a thick region having two radially directed through bores 9,10 located upstream and downstream of each other. A fixed arm 1 is embedded and bolted in the upstream bore 9 of each platform 4, and the pivot 3 of a movable vane 2 is mounted in the downstream bore 10 and is pivotable in this bore 10 within a hollow friction bush 11 which is rigidly connected to the platform 4. The pivotal movement of the pivot 3 of the movable vane 2 around the radial axis XX' is controlled by a link formed by interconnected upstream and downstream parts 12 and 13 respectively, the upstream part 12 being disposed inside the manifold S and the downstream part 13 outside. The upstream part 12 projects into the bore 10 of the platform 4 through facing apertures provided in the manifold 5, the platform 4 and the hollow friction bush 11.

The downstream part 13 is connected at one end to the upstream part 12 by means of a lock-nut 14 and has its opposite end linearly slidable in a ball-joint 15 held by a control and synchronization ring 16. The control of the pivotal movement of all the movable vanes is effected simultaneously by means of the control ring 16 in a manner known.

Figure 2:
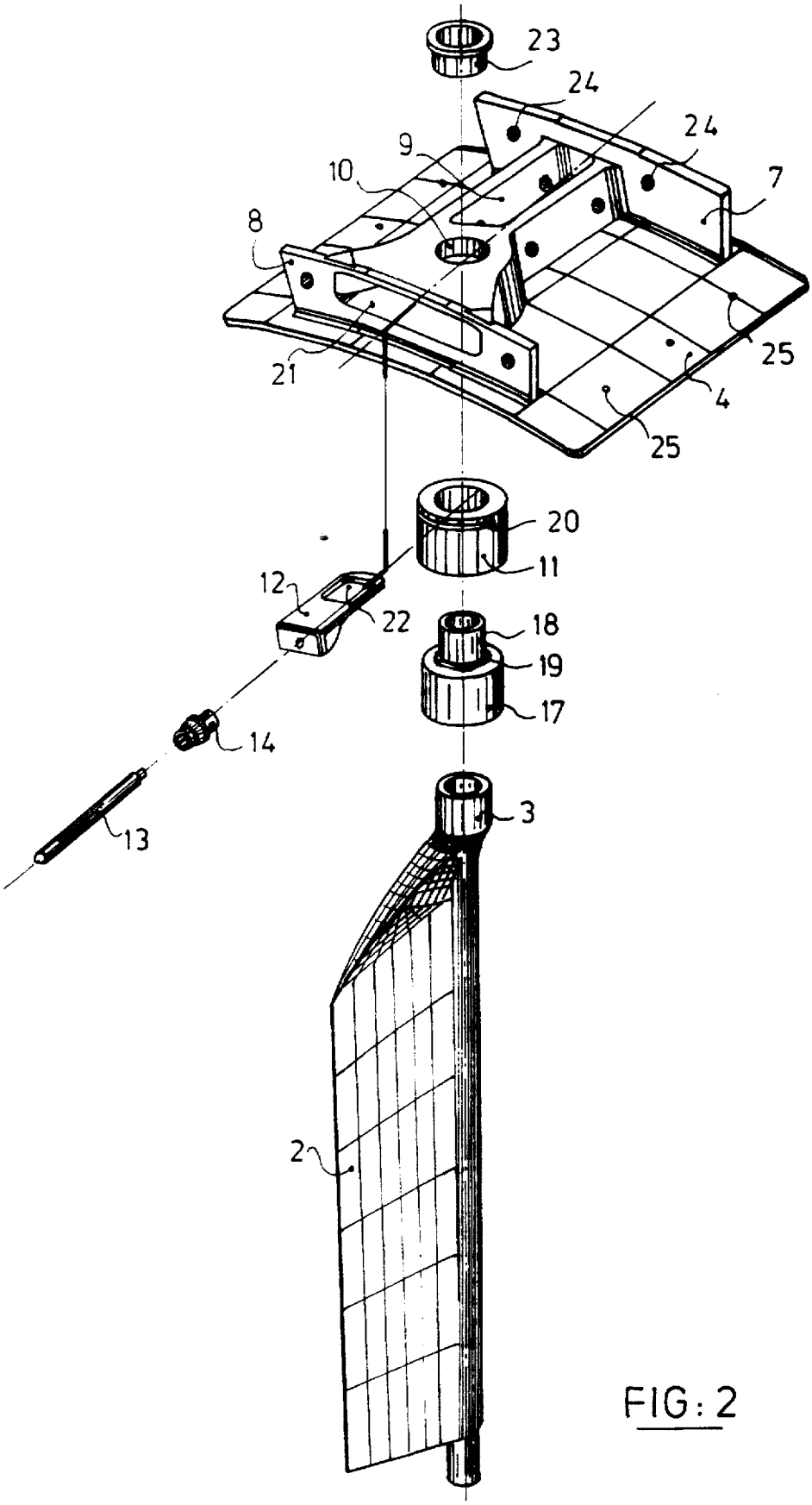
FIG. 2 is a perspective exploded view of the means for pivotally mounting the pivot of the movable vane in the embodiment shown in FIG. 1; and, FIG. 3 is a perspective view of the means for pivotally mounting the pivot of the vane after assembly of the components shown in FIG. 2.

FIG. 2 shows a perspective exploded view of the means for pivotally mounting and securing the pivot of a movable vane in the bore 10 of a platform 4. As already mentioned, a hollow friction bush 11 is fitted securely in the bore 10, the bush having near its upper end a circumferentially extending slit 20 of predetermined width facing an aperture 21 in the platform 4. The upstream part 12 of the link has a flat portion provided with an eye 22 of predetermined shape and section, for example square, and this flat portion projects into the downstream bore 10 of the platform 4 through the aperture 21 of the platform and the slit 20 of the hollow bush 11. The shape and the width of the slit 20 and of the aperture 21 are determined by the kinematics of the link 12.

Fitted securely on the pivot 3 is an end-piece 17 comprising a threaded upper part 18, an intermediate part 19 of predetermined shape and section, and a lower part which receives the pivot 3. The shape of the intermediate part 19 is complementary to that of the eye 22 of the upstream part 12 of the link, and its section is slightly less than that of the eye 22. Thus, when the pivot 3 fitted with its end-piece 17 is placed in position within the bush 11 in the bore 10 of the platform 4, the intermediate part 19 fits exactly into the eye 22 of the link 12 to provide a rotational driving connection between the link and the pivot 3. This connection is maintained by clamping means, for example in the form of a shouldered nut 23 screwed on the upper threaded part 18 of the end-piece 17.

In order that the vanes will all be oriented accurately relative to each other, it is necessary that the orientation of the intermediate part 19 of each end-piece 17 should be set accurately relative to the respective vane 2. Similarly, the slit 20 of the bush 11 must be oriented very precisely relative to the platform 4. For this purpose, it is preferable to use an assembly kit or alignment means.

When the pivot 3 fitted with its end-piece 17 is mounted in the platform 4 together with the friction bush 11, the upstream part 12 of the link and the clamping nut 23, the platform 4 is positioned in the manifold 5 and the upstream and downstream flanges 7,8 are fixed to the corresponding flanges of the manifold 5. For this purpose, the flanges 7,8 are provided with several holes 24 through which fixing means (not shown) can be inserted in a known manner.

Similarly, holes 25 are provided for the fixing of the various platforms to each other.

The downstream part 13 of the link situated outside the manifold 5 is then fixed at its first end to the upstream part 12, for example by screwing and then clamping with a locknut 14, and the other end of the downstream part 13 which may have a square section for example, is fitted into a ball joint 15 (not shown in FIG. 2) carried by the ring 16 for control and synchronization of the pivotal movement of the vanes.

Figure 3:
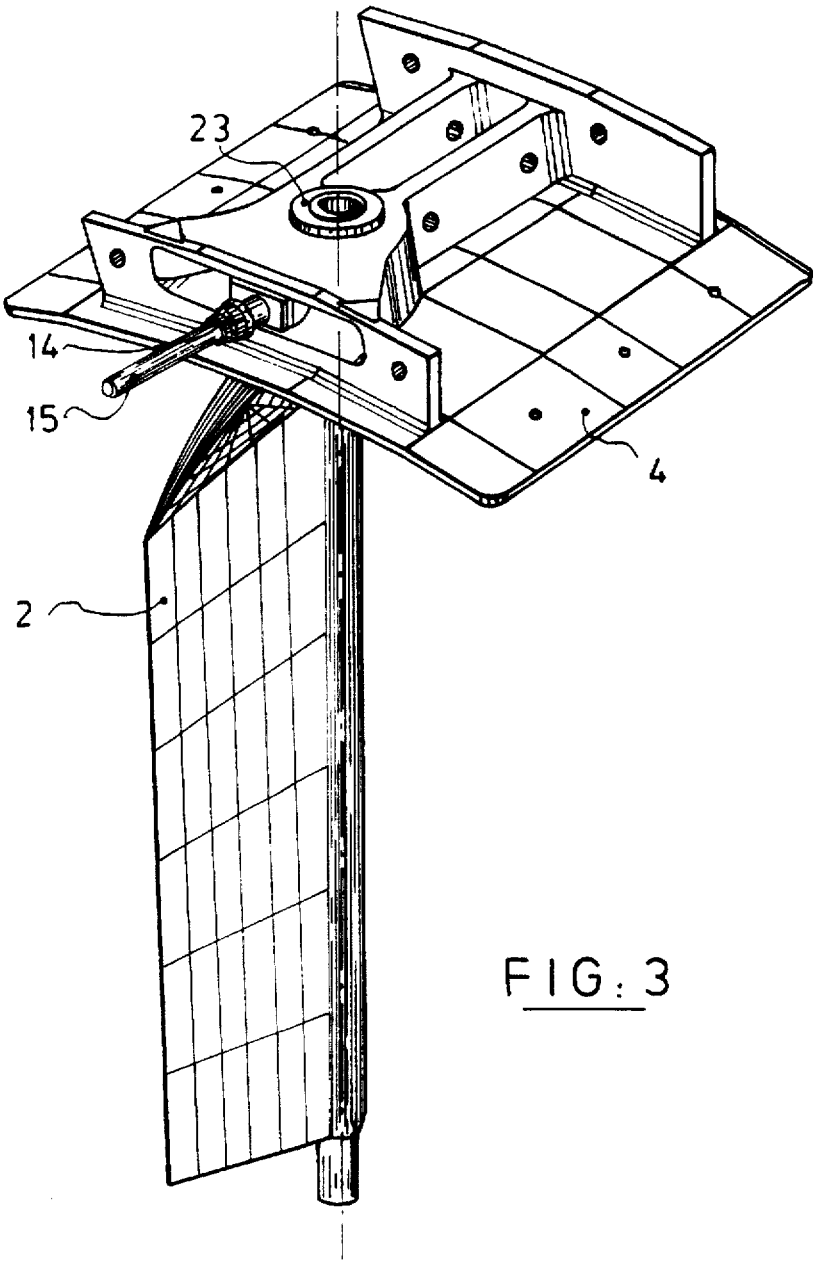

FIG. 3 shows that, after assembly, the means for pivotally mounting and securing the pivot of the movable vane is fully integrated in the downstream bore 10 of the platform 4 and is confined in a very small space.

Because the pivot 3 of the vane, the bush 11 and the clamping nut 23 are all hollow, they allow the admission of the hot de-icing air from the manifold 5 into the movable vane.

The slit 20 of the bush 11 and the hole 21 of the platform 4 allow operation of the device which controls the swivelling of the variably settable vanes and which is situated outside the manifold 5.

I claim:

1. A control device for a pivot of a variably settable movable vane comprising:

a platform which is fixed to an air manifold by upstream and downstream flanges, said platform provided with a bore for receiving said pivot;

means for pivotally mounting said pivot in said bore;

a link for rotating said pivot to swivel said movable vane and thereby vary the setting thereof; and, means connected to said link for controlling the swivelling of said movable vane;

wherein said means for pivotally mounting said pivot include a hollow friction bush fixed in said bore, said hollow bush having a slit extending partly around the bush in a circumferential direction, said link having an upstream end part which projects through said slit and wherein said link extends into an interior of said hollow bush.

2. A control device according to claim 1, wherein said means for controlling the swivelling of said movable vane is mounted outside said manifold and is connected to a downstream end part of said link, and wherein said upstream end part of said link projects through said slit of said hollow bush via apertures provided in said manifold and said platform.

3. A control device according to claim 2, wherein said slit in said hollow bush faces said apertures in said platform and said manifold.

4. A control device according to claim 3, wherein said upstream end part of said link comprises a flat portion provided with an eye having a predetermined shape and section, said flat portion projecting through said slit of said hollow friction bush.

5. A control device according to claim 4, wherein said means for pivotally mounting said pivot further comprises:

a hollow end piece fitted on said pivot; and, a clamping nut;

wherein said hollow end piece includes a lower part into which said pivot is fitted wherein said hollow end piece fits into said hollow friction bush, an intermediate part which fits into said eye of said upstream part of said link, and a threaded upper part on which said clamping nut is screwed.

6. A control device according to claim 1, wherein said pivot is hollow to allow a flow of hot de-icing air from said air manifold into the interior of said vane.

* * * * *